US005807130A

United States Patent [19]

Miller et al.

[11] Patent Number: 5,807,130

[45] Date of Patent: Sep. 15, 1998

[54] TWO WAY ELECTRICAL CONNECTOR

[75] Inventors: James A. Miller, Novi; Robert L. Brickner, Berkley; John V. Antilla, Sterling Heights, all of Mich.

[73] Assignee: Chrysler Corporation, Auburn Hills, Mich.

[21] Appl. No.: 656,677

[22] Filed: May 31, 1996

[51] Int. Cl.[6] ..... H01R 13/627

[52] U.S. Cl. ..... 439/352

[58] Field of Search ..... 439/488, 489, 439/352, 357, 358, 680, 681

[56] References Cited

U.S. PATENT DOCUMENTS

| | | | |
|---|---|---|---|
| 3,937,545 | 2/1976 | Cairns et al. . | |
| 4,166,664 | 9/1979 | Herrmann, Jr. . | |
| 4,214,472 | 7/1980 | Maxwell et al. . | |
| 4,214,802 | 7/1980 | Otani et al. . | |
| 4,284,312 | 8/1981 | Patchett et al. . | |
| 4,498,719 | 2/1985 | Juris et al. . | |
| 4,557,542 | 12/1985 | Coller et al. | 439/595 |
| 4,571,017 | 2/1986 | Fujita . | |
| 4,621,883 | 11/1986 | Noguchi . | |
| 4,637,674 | 1/1987 | Kobler . | |
| 4,698,027 | 10/1987 | Vandame . | |
| 4,709,123 | 11/1987 | Yamashita et al. . | |
| 4,735,581 | 4/1988 | Endo et al. . | |
| 4,768,970 | 9/1988 | Nestor . | |
| 4,772,231 | 9/1988 | Hayes . | |
| 4,797,116 | 1/1989 | Isohata et al. . | |
| 4,810,208 | 3/1989 | Hayes et al. . | |
| 4,820,181 | 4/1989 | Kuzuno et al. . | |
| 4,836,802 | 6/1989 | Phillips . | |
| 4,874,325 | 10/1989 | Bensing et al. . | |
| 4,895,533 | 1/1990 | Yagi et al. . | |
| 4,921,437 | 5/1990 | Cooper et al. . | |
| 4,936,791 | 6/1990 | Zielinski et al. . | |
| 4,946,402 | 8/1990 | Fink et al. . | |
| 4,950,175 | 8/1990 | Plyler et al. . | |
| 4,973,266 | 11/1990 | Bullard . | |
| 4,984,998 | 1/1991 | Duncan et al. | 439/352 |
| 4,993,803 | 2/1991 | Suverison et al. . | |
| 5,021,923 | 6/1991 | Zinn . | |
| 5,078,622 | 1/1992 | Hunt, III et al. . | |
| 5,104,253 | 4/1992 | Zielinski et al. . | |
| 5,108,303 | 4/1992 | Maeda et al. . | |
| 5,112,241 | 5/1992 | Chesnut et al. . | |
| 5,114,359 | 5/1992 | Chishima et al. . | |
| 5,197,898 | 3/1993 | Nagamine . | |
| 5,224,872 | 7/1993 | Noda et al. . | |
| 5,234,352 | 8/1993 | Bungo et al. . | |
| 5,234,356 | 8/1993 | Maejima et al. | 439/357 |
| 5,240,431 | 8/1993 | Yagi et al. . | |
| 5,263,873 | 11/1993 | Landries . | |
| 5,304,073 | 4/1994 | Golobay et al. . | |
| 5,328,382 | 7/1994 | Pawlicki . | |
| 5,336,101 | 8/1994 | Kasugai et al. . | |
| 5,350,311 | 9/1994 | Roy et al. . | |
| 5,358,420 | 10/1994 | Cairns et al. . | |
| 5,370,543 | 12/1994 | Hamada et al. | 439/352 |
| 5,389,005 | 2/1995 | Kodama . | |
| 5,431,574 | 7/1995 | Shinchi . | |
| 5,435,738 | 7/1995 | Isohata . | |
| 5,435,743 | 7/1995 | Farah . | |
| 5,484,301 | 1/1996 | Koumatsu et al. . | |

*Primary Examiner*—Gary F. Paumen
*Assistant Examiner*—Yong Ki Kim
*Attorney, Agent, or Firm*—Thomas G. Pasternak

[57] ABSTRACT

A two way electrical connector for an automotive vehicle includes a terminal insulator having at least one passage to receive at least one box terminal staked wire, a wedge member cooperating with the terminal insulator to retain the at least one box terminal staked wire in the at least one passage and a connector position assurance member cooperating with the terminal insulator to detect and indicate an unmated condition of the terminal insulator to a mating connector.

21 Claims, 3 Drawing Sheets

TWO WAY ELECTRICAL CONNECTOR

BACKGROUND OF THE INVENTION

1. Field of the Invention

The present invention relates generally to electrical connectors and, more particularly, to a two way electrical connector for an automotive vehicle which is fully assembled and ready to receive and retain terminal staked wires.

2. Description of the Related Art

Electrical connectors have been provided to connect and retain wires together on an automotive vehicle. These electrical connectors typically include a terminal insulator requiring assembly of external wedges to retain and lock box terminal staked wires after positioning within the terminal insulator.

One disadvantage of these electrical connectors is that the external wedge is small and specific orientation is required to effect an assembly which is often a tedious process. Another disadvantage is that the terminal insulator typically requires an auditory confirmation of proper assembly to a mating device which is difficult under noisy assembly conditions. Thus, there is a need in the art to provide a two way electrical connector for an automotive vehicle which in a simple manner allows box terminal staked wires to be positioned and locked into position without the need for great manual dexterity or handling of auxiliary locking devices which may become misplaced or damaged. There is also a need in the art for physical detection of a partially mated condition of an electrical connector for an automotive vehicle to a mating connector in lieu of auditory confirmation.

SUMMARY OF THE INVENTION

It is, therefore, one object of the present invention to provide a two way electrical connector for an automotive vehicle.

It is another object of the present invention to provide a unitary two way electrical connector for an automotive vehicle which permits rapid assembly to a mating connector without the need of handling, orientating or assembling ancillary parts.

It is yet another object of the present invention to provide a two way electrical connector for an automotive vehicle which is fully assembled and ready to receive and retain box terminal staked wires.

It is still another object of the present invention to provide a two way electrical connector having physical detection of an unmated condition between the electrical connector and a mating connector.

To achieve the foregoing objects, the present invention is a two way electrical connector for an automotive vehicle including a terminal insulator having at least one passage to receive at least one box terminal staked wire. The two way electrical connector also includes a wedge member cooperating with the terminal insulator to retain the at least one box terminal staked wire in the at least one passage and a connector position assurance member cooperating with the terminal insulator to detect and indicate an unmated condition of the terminal insulator to a mating connector.

One feature of the present invention is that a two way electrical connector is provided for an automotive vehicle. Another feature of the present invention is that the two way electrical connector has a terminal insulator with integrally molded spring fingers which receive a properly configured box terminal staked wire and maintain the box terminal staked wire in position until a locking motion is completed. Yet another feature of the present invention is that the terminal insulator has a shroud which positions and maintains a connector position assurance member in place upon the terminal insulator. Still another feature of the present invention is that the two way electrical connector includes a preloaded wedge member which engages the spring fingers in a manner which will lock the spring fingers into position with the box terminal staked wires when the locking motion is introduced. A further feature of the present invention is that the two way electrical connector includes a connector position assurance member which detects a partially unmated condition to a mating connector and indicates the proper installation of the terminal insulator to the mating connector.

Other objects, features and advantages of the present invention will be readily appreciated as the same becomes better understood after reading the subsequent description taken in conjunction with the accompanying drawings.

DESCRIPTION OF THE PREFERRED EMBODIMENT(S)

Figure 1:
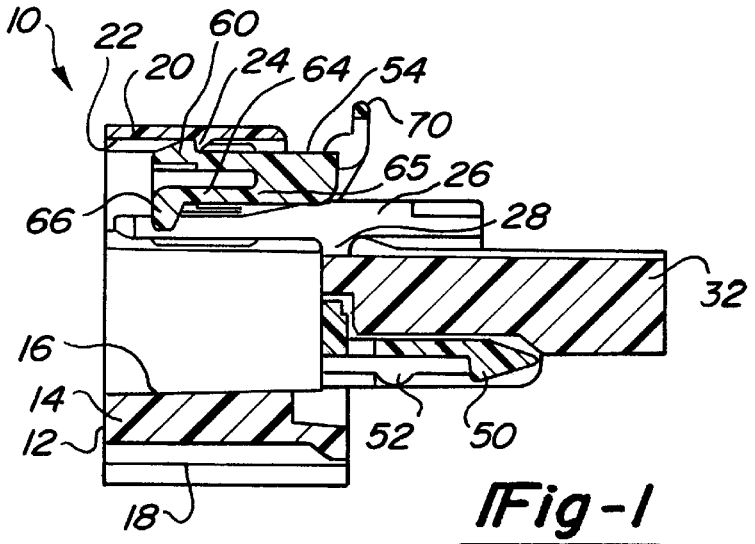
FIG. 1 is a fragmentary elevational view of a two way electrical connector, according to the present invention, illustrating a connector position assurance member in a preload assembly position and a wedge member in a final assembly position.
Figure 2:
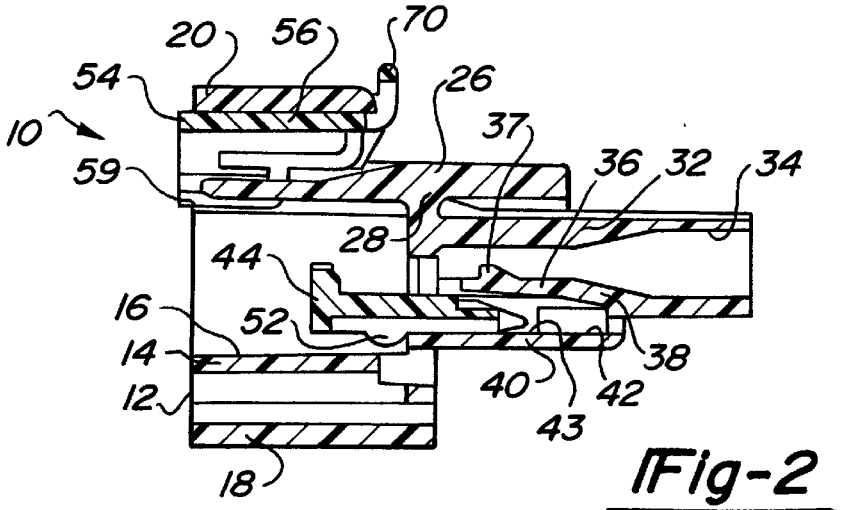
FIG. 2 is another fragmentary elevational view of the two way electrical connector of FIG. 1 illustrating the connector position assurance member in a final assembly position and the wedge member in a preload assembly position.
Figure 3:
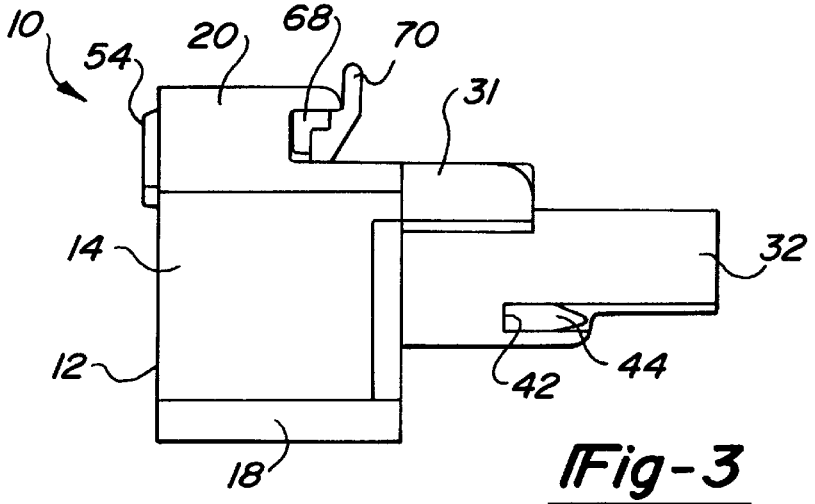
FIG. 3 is an elevational view of the two way electrical connector of FIG. 1 in a final assembly position.
Figure 4:
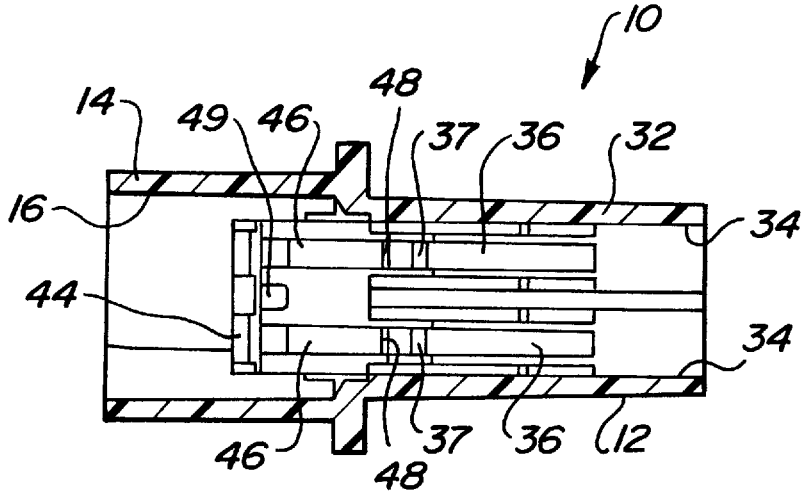
FIG. 4 is a fragmentary plan view of the two way electrical connector of FIG. 1 illustrating the wedge member in a preload assembly position.
Figure 5:
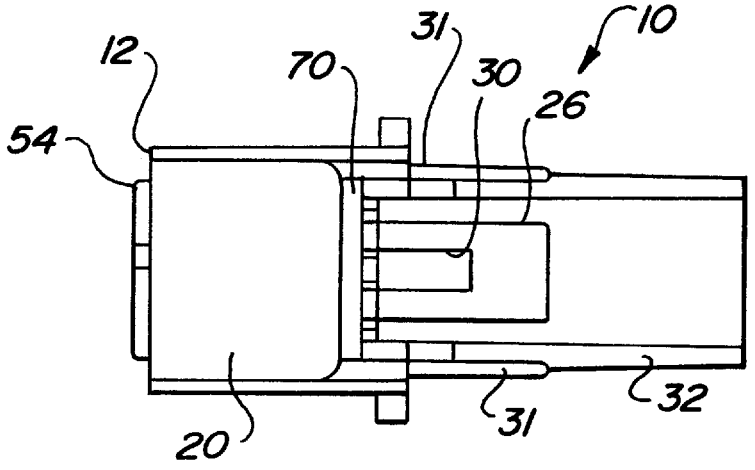
FIG. 5 is a plan view of the two way electrical connector of FIG. 2 in a preload assembly position.

Referring to FIGS. 1 through 7, a two way electrical connector 10, according to the present invention, is shown for an automotive vehicle (not shown). The two way electrical connector 10 is used for receiving and retaining box terminal staked wires (not shown) of the automotive vehicle. It should be appreciated that box terminal staked wires are conventional and known in the art.

The two way electrical connector 10 includes a terminal insulator 12 for receiving the box terminal staked wires. The terminal insulator 12 is preferably a one-piece molded plastic member. The terminal insulator 12 includes a forward engaging shroud 14 having a cavity 16 contoured to receive and align a suitably designed mating connector (not shown). Preferably, the shroud 14 and cavity 16 extend longitudinally and are generally rectangular in shape. The cavity 16 has a polarizing portion 17 which extends vertically and transversely to form a channel to receive and align with a suitably designed projection on the mating connector. It should be appreciated that the polarizing portion 17 prevents assembly of the terminal insulator 12 to an incorrect mating connector.

The terminal insulator 12 includes a retaining portion 18 extending vertically from a lower side of the shroud 14. The retaining portion 18 includes a pair of clip hangers 19 extending vertically and spaced transversely to form a generally inverted U-shape for receiving a plastic fastener (not shown). It should be appreciated that the retaining portion 18 is integral and molded as one-piece with the shroud 14. It should also be appreciated that the retaining portion 18 is secured to vehicle structure (not shown) by the plastic fastener.

The terminal insulator 12 includes a hood 20 extending vertically from an upper side of the shroud 14. The hood 20 is generally rectangular in shape and has an aperture 22 extending longitudinally therethrough. The hood 20 includes a locking projection or rib 24 which extends transversely and into the aperture 22 to provide a locking surface for a connector position assurance member 54 to be described.

The terminal insulator 12 also includes a latch 26 disposed between the shroud 14 and hood 20. The latch 26 extends longitudinally and is cantilevered by a connecting portion 28 to the shroud 14. The latch 26 has a slot 30 extending therethrough. The slot 30 extends longitudinally and is generally rectangular in shape for a function to be described. The terminal insulator 12 includes a pair of ribs 31 spaced transversely and extending longitudinally from the hood 20 the length of the latch 26. The hood 20 and ribs 31 protect the latch 26 from damage during shipping and handling. It should be appreciated that the ribs 31 are integral and formed as one piece with the hood 20. It should also be appreciated that the latch 26 is integral and formed as one piece with the shroud 14. It should further be appreciated that the connecting portion 28 allows the latch 26 to be flexed or deflected.

The terminal insulator 12 further includes a terminal receiving portion 32 extending longitudinally from the shroud 14 to receive terminal wires (not shown). The terminal receiving portion 32 includes at least one, preferably a plurality of passages 34 extending longitudinally therethrough and communicating with the cavity 16. The terminal receiving portion 32 includes a terminal retention finger 36 disposed in each passage 34 and having a projection 37 which engages a hole or aperture in the box terminal staked wire (not shown). The terminal retention finger 36 extends longitudinally and is cantilevered by a connecting portion 38 to the terminal receiving portion 32. It should be appreciated that the terminal receiving portion 32 is integral and formed as one-piece with the shroud 14. It should also be appreciated that the connecting portion 38 allows the terminal retention finger 36 to be flexed or deflected to engage or disengage the hole in the box terminal staked wire.

The terminal insulator 12 includes a spring beam 40 extending vertically from the terminal receiving portion 32. The spring beam 40 extends longitudinally and has an aperture or slot 42 extending longitudinally therethrough and communicating with the cavity 16. The slot 42 is generally rectangular in shape. The spring beam 40 includes a removal slot 43 on each transverse side thereof and communicating with the slot 42 for a function to be described. It should be appreciated that the spring beam 40 is integral and formed as one-piece with the terminal receiving portion 32.

The two way electrical connector 10 also includes a wedge member 44 which cooperates with the spring beam 40. The wedge member 44 has a generally "L" shaped profile. The wedge member 44 includes at least one, preferably a pair of locking wedge pads 46 which are transversely spaced and extend longitudinally. The locking wedge pads 46 are inclined or ramped. The wedge member 44 also includes a misinstallation detector or recess 48 at the end of each locking wedge pad 46. The wedge member 44 includes a removal slot 49 disposed between the locking wedge pads 46 at the other end of the locking wedge pads 46 to allow complete removal of the wedge member 44 from the terminal insulator 12. The wedge member 44 also includes a preload positioning projection 50 extending vertically from a lower surface thereof and at least one, preferably a pair of fully assembled locking projections 52 extending vertically from the lower surface and being transversely spaced and spaced longitudinally from the preload positioning projection 50.

In operation, the spring beam 40 aligns and retains the wedge member 44. In the preload assembly position illustrated in FIG. 2, the preload positioning projection 50 engages the slot 42 in the spring beam 40 and the fully assembled locking projections 52 restrict engagement motion of the wedge member 44, thereby preventing accidental sliding engagement of the locking wedge pads 46 behind the terminal staked fingers 36. When each box terminal staked wire is fully inserted in each of the passages 34, the wedge member 44 is deliberately slid behind or underneath the terminal retention finger 36 and the projection 37 is seated within a corresponding aperture of the box terminal staked wire. It should be appreciated that the fully assembled locking projections 52 engage the slot 42 in the spring beam 40 as illustrated in FIG. 1.

When in the fully assembled position as illustrated in FIG. 1, the wedge member 44 prevents the retention finger 36 from flexing, locking the box terminal staked wire (not shown) into place. It should be appreciated that the misinstallation recess 48 of the wedge member 44 may detect a misinstalled box terminal staked wire by colliding with a terminal retention finger 36 deflected by a partially installed box terminal staked wire. It should also be appreciated that the removal slot 49 allows for disengaging the wedge member 44 from the final assembly position. It should further be appreciated that the wedge member 44 may detect improperly loaded box terminal staked wires by its inability to become fully engaged with the terminal insulator 12, thereby obstructing installation of the terminal insulator 12 to the mating connector.

Figure 6:
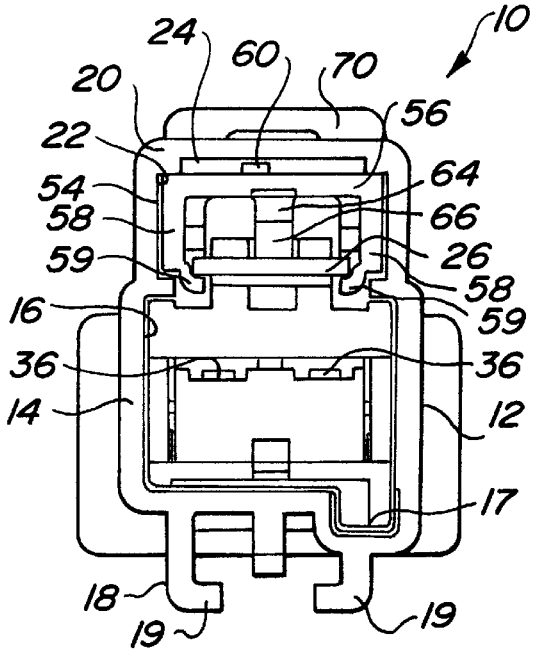
FIG. 6 is an end view of the two way electrical connector of FIG. 1 in a preload assembly position.
Figure 7:
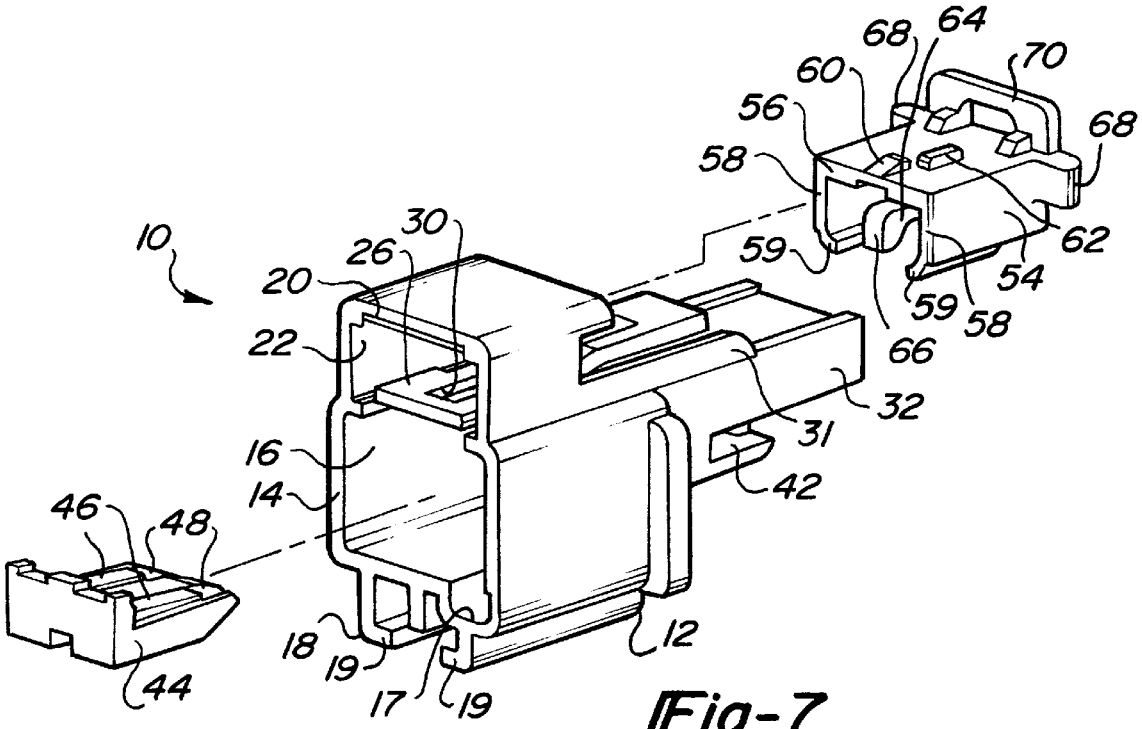
FIG. 7 is an exploded perspective view of the two way electrical connector of FIG. 1.

The two way electrical connector 10 also includes a connector position assurance member 54. The connector position assurance member 54 is generally rectangular in shape and includes a base wall 56 and side walls 58 forming a generally inverted U-shape. The side walls 58 each have a stabilizing appendage 59 extending transversely toward each other which position and retain the latch 26 in a proper attitude in relation to the mating connector as illustrated in FIG. 6. The connector position assurance member 54 includes a preload locking projection 60 extending upwardly from the base wall 56 and a fully assembled locking projection 62 extending upwardly from the base wall 56, each of which cooperates with the locking rib 24 of the hood 20. It should be appreciated that the hood 20 guides and retains the connector position assurance member 54. It should also be appreciated that the hood member 20 also protects the latch 26 from compression set during packaging and shipping conditions.

The connector position assurance member 54 includes a preload stop finger 64 which is cantilevered to the base wall 56 by a connecting portion 65 and disposed between the side walls 58. The preload stop finger 64 includes a projection 66 extending generally perpendicular therefrom to engage the slot 30 in the latch 26. The preload stop finger 64 prevents the connector position assurance member 54 from travelling past the locking rib 24 on the terminal insulator 12 by the projection 66 abutting the end of the slot 30 in the latch 26. The preload stop finger 64 is deflected upon assembly of the two way electrical connector 10 with the mating connector (not shown) to disengage the projection 66 from the slot 30 which allows the connector position assurance member 54 to move in a longitudinal direction along the latch 26 until it assumes the final assembly position of FIG. 2.

The connector position assurance member 54 also includes at least one, preferably a pair of forward stop ribs 68 extending outwardly on each side wall 58 to provide a positive stop on the connector position assurance member 54 with the hood 20. The connector position assurance member 54 also includes an installation rib 70 extending from the base wall 56 which provides an area to apply a compressive force by an operator to slide the connector position assurance member 54 into its final assembly position.

In operation, the connector position assurance member 54 is aligned and retained by the latch 26. In the preload assembly position illustrated in FIG. 1, the stabilizing appendages 59 are disposed about the latch 26 with the projection 66 disposed in the slot 30 of the latch 26. The preload locking projection 60 is disposed longitudinally past the locking rib 24 of the hood 20 with the fully assembled locking projection 62 disposed longitudinally on the other side of the locking rib 24, thereby preventing sliding motion of the connector position assurance member 54. When willful and suitable pressure is applied to the connector position assurance member 54, the connector position assurance member 54 slides forward such that the fully assembled locking projection 62 is disposed on the other side of the locking rib 24. The terminal insulator 12 is mated or installed to the mating connector which is received in the cavity 16 of the shroud 14. The preload stop finger 64 is deflected. The connector position assurance member 54 is then slid forward until the forward stop ribs 68 abut the hood 20.

According, the two way electrical connector 10 has three preassembled components, the terminal insulator 12, wedge member 44 and connection position assurance member 54, with features to receive and retain a plurality of box terminal staked wires. When the box terminal staked wires are properly installed within the terminal insulator 12, the wedge member 44 can be fully assembled to lock the box terminal staked wires in position within the terminal insulator 12. Additionally, a connector position assurance member 54, permanently assembled to the terminal insulator 12, will detect when the terminal insulator 12 is properly mated with a mating connector permitting a reversible locking action.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A two way electrical connector for an automotive vehicle comprising:

a terminal insulator having at least one passage to receive at least one box terminal staked wire, said terminal insulator having a forward engaging shroud including a cavity to receive a mating connector, said terminal insulator also including a hood extending from said forward engaging shroud and having an aperture extending longitudinally therethrough;

a wedge member cooperating with said terminal insulator to retain the at least one box terminal staked wire in said at least one passage;

a connector position assurance member cooperating with said terminal insulator to detect and indicate an unmated condition of said terminal insulator to a mating connector, and a locking rib extending from said hood and into said aperture for cooperating with said connector position assurance member.

2. A two way electrical connector as set forth in claim 1 wherein said wedge member is preassembled to said terminal insulator.

3. A two way electrical connector as set forth in claim 1 wherein said connector position assurance member is preassembled to said terminal insulator.

4. A two way electrical connector as set forth in claim 1 wherein said cavity includes a polarizing portion which aligns and prevents misassembly to the mating connector.

5. A two way electrical connector as set forth in claim 1 including a latch disposed between said forward engaging shroud and said hood and connected to said forward engaging shroud.

6. A two way electrical connector as set forth in claim 5 wherein said latch has a slot extending therethrough to receive a portion of said connector position assurance member.

7. A two way electrical connector as set forth in claim 1 wherein said terminal insulator includes a terminal receiving portion extending from said forward engaging shroud and forming said at least one passage.

8. A two way electrical connector as set forth in claim 7 wherein said terminal receiving portion includes a terminal retention finger disposed in said at least one passage and having a projection to engage the box terminal.

9. A two way electrical connector as set forth in claim 1 including a spring beam having a slot extending therethrough to receive said wedge member.

10. A two way electrical connector as set forth in claim 1 wherein said wedge member includes means for retaining said wedge member in a preload assembly position and means for retaining said wedge member in a final assembly position.

11. A two way electrical connector as set forth in claim 1 wherein said wedge member includes means for detecting an improperly installed box terminal staked wire.

12. A two way electrical connector as set forth in claim 1 wherein said wedge member includes means for cooperating with said terminal insulator for preventing unintentional removal of a box terminal staked wire when said wedge member is in a final assembly position.

13. A two way electrical connector as set forth in claim 1 wherein said wedge member includes means for cooperating with said terminal insulator for allowing a box terminal staked wire to be retained in said at least one passage.

14. A two way electrical connector as set forth in claim 1 wherein said connector position assurance member includes means for detecting a misinstalled condition of said terminal insulator relative to the mating connector.

15. A two way electrical connector as set forth in claim 1 wherein said connector position assurance member includes means for preventing unintentional removal of said terminal insulator from the mating connector.

16. A two way electrical connector for an automotive vehicle comprising:

a terminal insulator having at least one passage to receive at least one box terminal staked wire, said terminal insulator having a forward engaging shroud including a cavity to receive a mating connector, said terminal insulator having a hood extending from said forward engaging shroud and having an aperture extending longitudinally therethrough;

a wedge member cooperating with said terminal insulator to retain the at least one box terminal staked wire in said at least one passage; and a connector position assurance member cooperating with said terminal insulator to detect and indicate an unmated condition of said terminal insulator to a mating connector;

wherein a locking rib extends from said hood and into said aperture for cooperating with said connector position assurance member.

17. A two way electrical connector for an automotive vehicle comprising:

a terminal insulator having at least one passage to receive at least one box terminal staked wire, said terminal insulator having a forward engaging shroud including a cavity to receive a mating connector, said terminal insulator having a hood extending from said forward engaging shroud and having an aperture extending longitudinally therethrough;

a wedge member cooperating with said terminal insulator to retain the at least one box terminal staked wire in said at least one passage;

a connector position assurance member cooperating with said terminal insulator to detect and indicate an unmated condition of said terminal insulator to a mating connector; and wherein a latch is disposed between said forward engaging shroud and said hood and is connected to said forward engaging shroud, and said latch has a slot extending therethrough to receive a portion of said connector position assurance member.

18. A two way electrical connector for an automotive vehicle comprising:

a terminal insulator having at least one passage to receive at least one box terminal staked wire;

said terminal insulator having a forward engaging shroud including a cavity to receive a mating connector;

a wedge member cooperating with said terminal insulator to retain at least one box terminal staked wire in said at least one passage;

said terminal insulator including a spring beam having a slot extending therethrough to receive said wedge member; and a connector position assurance member cooperating with said terminal insulator to detect and indicate an unmated condition of said terminal insulator to a mating connector.

19. A two way electrical connector for an automotive vehicle comprising:

a terminal insulator having at least one passage to receive at least one box terminal staked wire;

a wedge member cooperating with said terminal insulator to retain the at least one box terminal staked wire in said at least one passage;

a connector position assurance member cooperating with said terminal insulator to detect and indicate an unmated condition of said terminal insulator to a mating connector; and said connector position assurance member including a deflectable member attached to a wall, and having a portion for engaging a slot defined in said terminal insulator;

said portion of said deflectable member being disengageable from said slot upon assembly of the connector with a mating connector, thereby permitting said connector position assurance member to assume a final assembly position.

20. A two way electrical connector as set forth in claim 19 wherein said connector position assurance member has at least one member extending outwardly from a side wall of said connector position assurance member to provide a positive stop on the connector position assurance member with said terminal insulator.

21. A two way electrical connector as set forth in claim 20 wherein said connector position assurance member further includes a member extending from a base wall adjoining said side wall for providing an area to apply compressive force by an operator to slide said connector position assurance member into its final assembly position.

* * * * *